US009694973B2

(12) United States Patent
Ullrich et al.

(10) Patent No.: US 9,694,973 B2
(45) Date of Patent: Jul. 4, 2017

(54) ELECTRICAL POWERED WEIGHT AND FULLNESS LEVEL SYSTEM

(71) Applicants: Julie Ann Ullrich, Chicago, IL (US); Thomas Albert Ullrich, Chicago, IL (US)

(72) Inventors: Julie Ann Ullrich, Chicago, IL (US); Thomas Albert Ullrich, Chicago, IL (US)

(73) Assignee: DRATONX, INC, Chicago, IL (US)

( * ) Notice: Subject to any disclaimer, the term of this patent is extended or adjusted under 35 U.S.C. 154(b) by 0 days.

(21) Appl. No.: 14/071,516

(22) Filed: Nov. 4, 2013

(65) Prior Publication Data

US 2014/0125490 A1 May 8, 2014

Related U.S. Application Data

(60) Provisional application No. 61/722,177, filed on Nov. 4, 2012.

(51) Int. Cl.
*B65F 1/14* (2006.01)
*B65F 1/16* (2006.01)
(Continued)

(52) U.S. Cl.
CPC ..... *B65F 1/1405* (2013.01); *B30B 1/24* (2013.01); *B30B 9/321* (2013.01); *B65F 1/141* (2013.01);
(Continued)

(58) Field of Classification Search
CPC ..... B30B 9/3007–9/3042; B30B 9/321; B30B 1/24; B65F 2003/023;
(Continued)

(56) References Cited

U.S. PATENT DOCUMENTS 3,722,404 A * 3/1973 Moon ..... 100/52
4,156,386 A * 5/1979 Gould ..... 100/215
(Continued)

FOREIGN PATENT DOCUMENTS

CN 202296028 U 7/2012
CN 102815480 A 12/2012
(Continued)

*Primary Examiner* — Orlando Bousono
(74) *Attorney, Agent, or Firm* — Richards Patent Law, P.C.

(57) ABSTRACT

A collection apparatus weight and fullness level reporting system includes: an inlet; a removable collection bin receiving material placed into the collection apparatus; a compacting mechanism including a ram body, wherein the ram body travels between a home position located above the collection bin to a maximum travel position located inside the collection bin, wherein during each compaction cycle the ram body travels along a variable length of the compaction path; a fullness-reporting module that determines the height of the material in the collection bin; and a controller that determines the length of the compaction path the ram body travels during each compaction cycle based on the input received from the fullness reporting module, wherein at the end of each compaction cycle in which the material height is below a maximum height, the ram body is brought to rest at a height below the home position.

11 Claims, 14 Drawing Sheets

(51) Int. Cl.
*B30B 1/24* (2006.01)
*B30B 9/32* (2006.01)

(52) U.S. Cl.
CPC ..... *B65F 1/1426* (2013.01); *B65F 1/163* (2013.01); *B65F 2210/108* (2013.01); *B65F 2210/128* (2013.01); *B65F 2210/148* (2013.01); *B65F 2210/1443* (2013.01); *B65F 2210/172* (2013.01); *B65F 2210/184* (2013.01)

(58) Field of Classification Search
CPC . B65F 2210/108–2210/184; B65F 2210/1443; B65F 1/141; B65F 1/163; B65F 1/1405; B65F 1/1426
See application file for complete search history.

(56) References Cited

U.S. PATENT DOCUMENTS 4,470,747 A * 9/1984 Tichenor ..... 414/491
4,827,645 A 5/1989 Stamps
5,299,493 A 4/1994 Durbin et al.
5,303,642 A 4/1994 Durbin et al.
5,551,336 A * 9/1996 Griffin et al. ..... 100/353
5,645,172 A * 7/1997 Shantzis ..... 209/703
6,309,164 B1 * 10/2001 Holder et al. ..... 414/399
6,360,186 B1 3/2002 Durbin
6,408,261 B1 6/2002 Durbin
6,453,270 B1 9/2002 Durbin
6,561,085 B1 5/2003 Durbin et al.
6,687,656 B2 2/2004 Durbin et al.
6,738,732 B2 5/2004 Durbin et al.
7,000,532 B2 2/2006 Imperato
7,007,598 B1 3/2006 Patras
D564,545 S 3/2008 Poss et al.
7,578,511 B2 8/2009 Sheehan
7,819,054 B2 10/2010 Cunningham et al.
8,146,695 B1 4/2012 Ramshur
8,448,570 B1 5/2013 Turner
8,794,135 B1 * 8/2014 Simon et al. ..... 100/35
2002/0071749 A1 * 6/2002 Hund et al. ..... 414/408
2002/0091501 A1 * 7/2002 Durbin et al. ..... 702/188
2002/0108507 A1 * 8/2002 May et al. ..... 100/45
2003/0126714 A1 * 7/2003 Lynn ..... 15/257.1
2003/0172817 A1 * 9/2003 Durbin et al. ..... 100/50
2004/0020377 A1 * 2/2004 Touw et al. ..... 100/225
2005/0005785 A1 * 1/2005 Poss et al. ..... 100/240
2005/0019140 A1 * 1/2005 Hund et al. ..... 414/406
2005/0110330 A1 * 5/2005 Khan et al. ..... 298/22 R
2006/0021525 A1 * 2/2006 Geise ..... 100/214
2007/0101875 A1 * 5/2007 Poss et al. ..... 100/229 A
2007/0209529 A1 9/2007 Poss et al.
2008/0067227 A1 3/2008 Poss et al.
2008/0273955 A1 * 11/2008 Peguero ..... 414/487
2009/0013882 A1 * 1/2009 Cunningham et al. ..... 100/50
2009/0321449 A1 * 12/2009 Arthurson ..... 220/263
2010/0071572 A1 * 3/2010 Carroll et al. ..... 100/229 A
2010/0088203 A1 * 4/2010 Hynes et al. ..... 705/30
2010/0089259 A1 * 4/2010 Hallman et al. ..... 100/188 R
2010/0179912 A1 * 7/2010 Curotto ..... 705/308
2010/0206642 A1 * 8/2010 Curotto ..... 177/1
2011/0023434 A1 * 2/2011 Sadler ..... 56/16.6
2011/0036250 A1 * 2/2011 Cunningham et al. ..... 100/35
2011/0137484 A1 6/2011 Poss et al.
2011/0210124 A1 * 9/2011 Da Silva et al. ..... 220/484
2011/0265668 A1 * 11/2011 Cunningham et al. ..... 100/35
2011/0297017 A1 * 12/2011 Brown et al. ..... 100/237
2012/0067230 A1 * 3/2012 Fritz et al. ..... 100/35
2012/0073456 A1 3/2012 Lyle et al.
2012/0103206 A1 * 5/2012 Doaran et al. ..... 100/35
2012/0273498 A1 * 11/2012 Curotto ..... 220/495.06
2013/0098794 A1 * 4/2013 Clancy et al. ..... 206/459.1

FOREIGN PATENT DOCUMENTS

GB 2476937 A 7/2011
WO WO2008/154475 A1 12/2008
WO WO2012/015664 A1 2/2012
WO WO2012/035475 A1 3/2012

* cited by examiner

ELECTRICAL POWERED WEIGHT AND FULLNESS LEVEL SYSTEM

CROSS-REFERENCE TO RELATED APPLICATIONS

This application claims the benefit of U.S. Provisional Application No. 61/722,177, filed on Nov. 4, 2012, the entirety of which is incorporated herein by reference.

BACKGROUND OF THE INVENTION

The present subject matter relates generally to collection apparatuses, such as waste collection units. More specifically, the present invention relates specifically to solar power collection apparatuses including an electrically powered weight and fullness level reporting systems.

Collection apparatuses are used to collect materials such as waste, recycling, used cooking oil, clothing donations, and other unwanted materials for later collection and processing. Existing collection apparatuses are generally collected according to a schedule, regardless of the current level of fullness of the collection apparatuses. The fullness level itself is not apparent until after collection takes place. Accordingly, collection apparatuses are often collected below full capacity or at excess capacity. In addition to the clear optimization issues caused by non-optimal collection schedules, the failure to collect the contents of collection apparatuses that have exceeded their capacity can create risks for organizations and collection workers, such as sanitation workers.

Collecting apparatuses below full capacity results in poor resource utilization, especially poor labor utilization, which is the most costly component of the collection process. However, under existing collection processes, collection below apparatus capacity is often necessary to minimize the likelihood of overfilling and overweighting caused by unpredictable filling. Efforts to minimize poor labor utilization often result in more or larger-sized collection apparatuses that take up more space. Thus, there is a need to increase resource utilization by collecting closer to full capacity without increasing overfilling or requiring larger a collection apparatus.

With respect to public health, collection workers often manually collect collection apparatuses for garbage and recycling without information about possible risks. Risks include overweight collection apparatuses such as garbage cans, liners, or bags that may cause lifting injuries. Further risks include the health and environmental risks of overflowing collection apparatuses. The overflow from a collection apparatus may fall onto the street, parks, and benches, may draw the attention of unwanted pests, and increase water contamination risk. Thus, there is a need to appropriately time collections to minimize collection apparatus overflow.

Accordingly, there is a need for collection apparatuses including a weight and fullness system, as described herein.

BRIEF SUMMARY OF THE INVENTION

To meet the needs described above and others, the present disclosure provides collection apparatuses including electrically powered weight and fullness level systems to reduce collection overflows and to maximize the utilization of collection resources. A weight and fullness level system provides collection organizations and workers nearly real-time measures of the weight and fullness of collection apparatuses and other information to permit efficient collection, servicing, and operation of collection or filling apparatuses. It is further contemplated that the collection apparatus technology described herein may be implemented in other apparatuses such as a grease trap apparatus, a clothing donation apparatus, a street receptacle apparatus, a wheeled cart apparatus, a dumpster apparatus, etc. It is further contemplated that the collection apparatus technology may be used in filling or distribution embodiments, for example, fuel and water tanks.

In an embodiment intended for public curbside trash collection, the collection apparatus includes a deposit door for receiving collected materials that then fall into the collection bin. A foot pedal may be included to permit a user to operate the deposit door by foot. Indicators may be provided to show the current state of the collection apparatus. The collection apparatus may further include a compacting mechanism. The collection apparatus may include a solar panel mounted within or at the top of the collection apparatus. The solar panel may be protected from the elements by a cover, such as a clear, thermoformed polycarbonate. The solar panel may be adjustable, either manually or electromechanically, to improve sun exposure. Collection and service doors may be provided to permit access to the collected materials for collection by collection workers or to permit servicing of various components of the collection apparatus.

In an embodiment, a frame covered by panels structurally defines the collection apparatus. The frame may be a box frame constructed of angle irons or other materials defining the four corners supported by welded tubes or other materials to define the box shape of the collection apparatus and provide support to internal structures. The panels may be interchangeable to permit mounting on various sides of the collection apparatus and to permit varying placement of the collection door or other access doors. The panels may have slide hook attachments that secure the panels in place on the collection apparatus and align fastener holes for securing the panels with fasteners.

In an example, the collection apparatus may include a compacting mechanism to compact the collected materials. In one embodiment, the compacting mechanism includes a rack and pinion drive to compact the collected materials. In another embodiment, the compacting mechanism includes a screw drive to compact the collected materials, though there are numerous mechanisms that can be implemented for the compacting mechanism. An internal divider wall may be mounted in the collection apparatus to block access to the compacting mechanism when the door is opened.

To permit measurement of the weight and fullness of the collection device, the collection apparatus may include a fullness-reporting module. The fullness-reporting module may include a weight sensor and/or a height sensor to measure the weight and/or fullness of the collected materials. For example, the weight sensor may be a load cell, or in alternate embodiments, a bench scale platform. The fullness sensor may be an ultrasound sensor, laser distance measurement device, or a combination of ultrasound and laser distance measurement devices mounted to the top or sides of the collection bin to measure the current height of the collected materials. In some embodiments, multiple height sensors may be used to make multiple height measurements at various points to prevent uneven distribution of the collected materials from incorrectly indicating an incorrect fullness level. The fullness reporting module may be provided as single module that communicates with the controller or may be provided as several fullness reporting subsystems controlled by the controller using fullness reporting instructions.

The deposit door of the collection apparatus may provide access to an inlet feeding into the interior of the collection apparatus to deposit the collected materials. The deposit door may include a handle. In an embodiment, the deposit door is an independent sliding door utilizing that includes a linkage mechanism with a foot pedal. In another embodiment, the deposit door is an independent sliding door utilizing a pulley mechanism that is activated by the foot pedal. In a further embodiment, the deposit door is an independent sliding door utilizing a gear mechanism. In yet further embodiments, the deposit door is a swinging door that limits access to the collected materials. In other embodiments, the door may be a chute deposit door, a flip deposit door, an automated flip deposit door, or the deposit door may be omitted allowing unobstructed access to the interior.

In an embodiment, the collection apparatus weight and fullness level reporting system includes an inlet providing passage to the interior of the collection apparatus, a removable collection bin receiving material placed into the collection apparatus through the inlet, a compacting mechanism including a ram body, a fullness-reporting module including a height sensor that determines the height of the material in the collection bin, and a controller.

The collection apparatus may include a wireless communications module to communicate data to the remote servers and a location services module. For example, the wireless communications module may include cellular radio and a GPS radio. Cellular radio may be used to communicate with remote servers. GPS radio may be used to locate the collection apparatus and transmit the location to the remote server, functionality that may be especially useful for temporary or movable collection apparatuses. In some embodiments, the collection device may have a wired connection to communication networks.

As described, the collection apparatuses may communicate with one or more remote servers. In an embodiment, the collection apparatuses access a communications network, such as the Internet, via cellular towers to communicate with the remote server. The collection apparatuses may communicate data to the remote server, provide remote control of the collection apparatus, to receive system updates, and carry out other tasks. Any information collected by the controller, fullness reporting module, and any sensors in collection apparatus may be communicated to the remote server.

The collection apparatus may communicate weight and fullness readings to a remote server at scheduled times, upon opening or closing of one of the doors, after a compaction cycle, in response to a remote query, etc. The remote server may store the weight and fullness measurements along with the location of collection apparatus in a memory of the remote server and any other information received from the collection apparatus. The remote server may use the weight and fullness measurements and location information of various collection devices to generate a collection schedule for the collection of collected materials by collection workers. Additionally, the current level of compaction may be transmitted to a remote server periodically, after a compaction cycle, at the request of the remote server, or at any other useful time.

The collection apparatus may include a battery charger to keep the battery fully charged and report on the current battery energy levels using a battery charge level sensor. If battery energy levels are below programmed thresholds, the collection apparatus may disable the motor, power off some or all of the electronic functions of the collection apparatus, send a notification to a remote server, activate an indicator, and/or otherwise notify users, collection workers, and/or the collection organization. The battery charge level threshold may be the level needed to adequately run a subsequent compaction cycle, a fixed percentage of the total charge level, such as 10%, or an amount of charge equal to the solar power received during a period of time. Further, in response to low battery energy levels, the collection apparatus may switch to an intermediate compaction mode to conserve energy.

The collection apparatus may also include various communications subsystems to communicate with nearby systems. For example, near-field radio communications, such as Bluetooth or Wi-Fi, may be provided for local communication to enable, for example, service workers for access and/or control, or to enable interaction with an access key card for locking or unlocking. Additionally, in some embodiments, collection apparatuses may communicate with other collection apparatuses or other machines to form wireless mesh networks. Further, in some embodiments, the collection device may provide Internet access to nearby users via Wi-Fi or other communication protocols.

In some examples, the collection device may have one or more externally accessible power and/or communication ports. For example, USB ports may be used to permit communication with the collection device. A host USB connector may be provided for firmware updates. Additionally, an SD card connector may permit the transfer of instructions and data to and from the compaction apparatus. In some embodiments, the USB ports of the collection device may be accessible by the public to permit charging of user electronic devices. Of course, USB ports are merely one example of power and/or communication ports that may be used.

To compact collected materials, the ram body travels along a compaction path between a home position located above the collection bin to a maximum travel position located inside the collection bin. To conserve energy, during each compaction cycle the ram body may travels along a variable length of the compaction path, typically less than the full length of travel. For example, the controller may receive input from the fullness-reporting module and control the travel of the ram body by determining the length of the compaction path the ram body should travel during each compaction cycle based on the input received from the fullness-reporting module. In such an example, at the end of each compaction cycle in which the material height is below a maximum height, the ram body is brought to rest at a height above the material height and below the home position.

As another mechanism to conserve energy, the controller may control the compaction mechanism to travel less than the full depth into the collection bin. For example, the controller may receive input from a compaction motor load sensor indicating the load placed on the motor during each compaction cycle (which indirectly indicates how dense the material is compacted in the collection bin), and limit the travel of the ram body along the compaction path in a compaction cycle to a distance short of the maximum travel position based upon the combination of the material height and compaction motor load from a previous compaction cycle. This prevents the compaction motor from expending wasteful energy attempting to compact material that has already been fully compacted.

As a further mechanism to conserve energy, the controller may further receive input from a weight sensor indicating the weight of the material in the collection bin, and suspends compaction cycle activity when the weight sensor indicates the collection bin is storing a maximum weight of material.

In an example of the collection apparatus, the compacting mechanism is battery powered and the controller receives input from a battery charge level sensor. When the battery charge level is inadequate to run a subsequent compaction cycle, the controller may power off all of the electronic functions of the collection apparatus.

In another example, the collection apparatus includes a wireless communication module that communicates information from the fullness-reporting module to a remote server Additionally, the wireless communication module communicates information to one or more nearby collection apparatuses.

In an additional example, the collection apparatus includes a weight sensor indicating the weight of the material in the collection bin. The wireless communication module communicates information from the weight sensor to the remote server. Also, an on-site indicator may permit a user to read the weight directly.

In a further example, the collection apparatus includes a location services module in communication with the wireless communication module that reports the location of the collection apparatus to the remote server.

In yet another example, after the remote server receives information from the fullness-reporting module of each of a plurality of collection apparatuses, the remote server calculates a collection schedule for the plurality of the collection apparatus.

In another example, the collection apparatus includes a visual indicator visible from the exterior of the collection apparatus, wherein the visual indicator indicates a fullness level of the collection bin based on information provided by the fullness-reporting module.

In an additional example, the collection apparatus includes electrical components of the collection apparatus that are solar powered.

An object of the invention is to increase the efficiency of collection or filling resources.

Another object of the invention is to minimize overfilling or overweighting of collection apparatuses for safety and environmental purposes.

A further objective is to provide collection devices with sanitary and clean collection functionality.

An advantage of the invention is that it provides a collection apparatus optimized for collection to reduce collection times.

Another advantage of the invention is that is provides a collection apparatus optimized to efficiently use energy, including solar energy.

Another advantage of the invention is that it provides a collection apparatus that may be used as part of a system to optimize the use of collection resources, such as collection workers, collection trucks, etc.

A further advantage of the invention is that it provides a collection apparatus the may be remotely monitored and controlled.

Yet a further advantage of the invention is that it provides improved infrastructure through increased technology options such as machine-to-machine communications, digital advertising (including amber alerts), etc.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
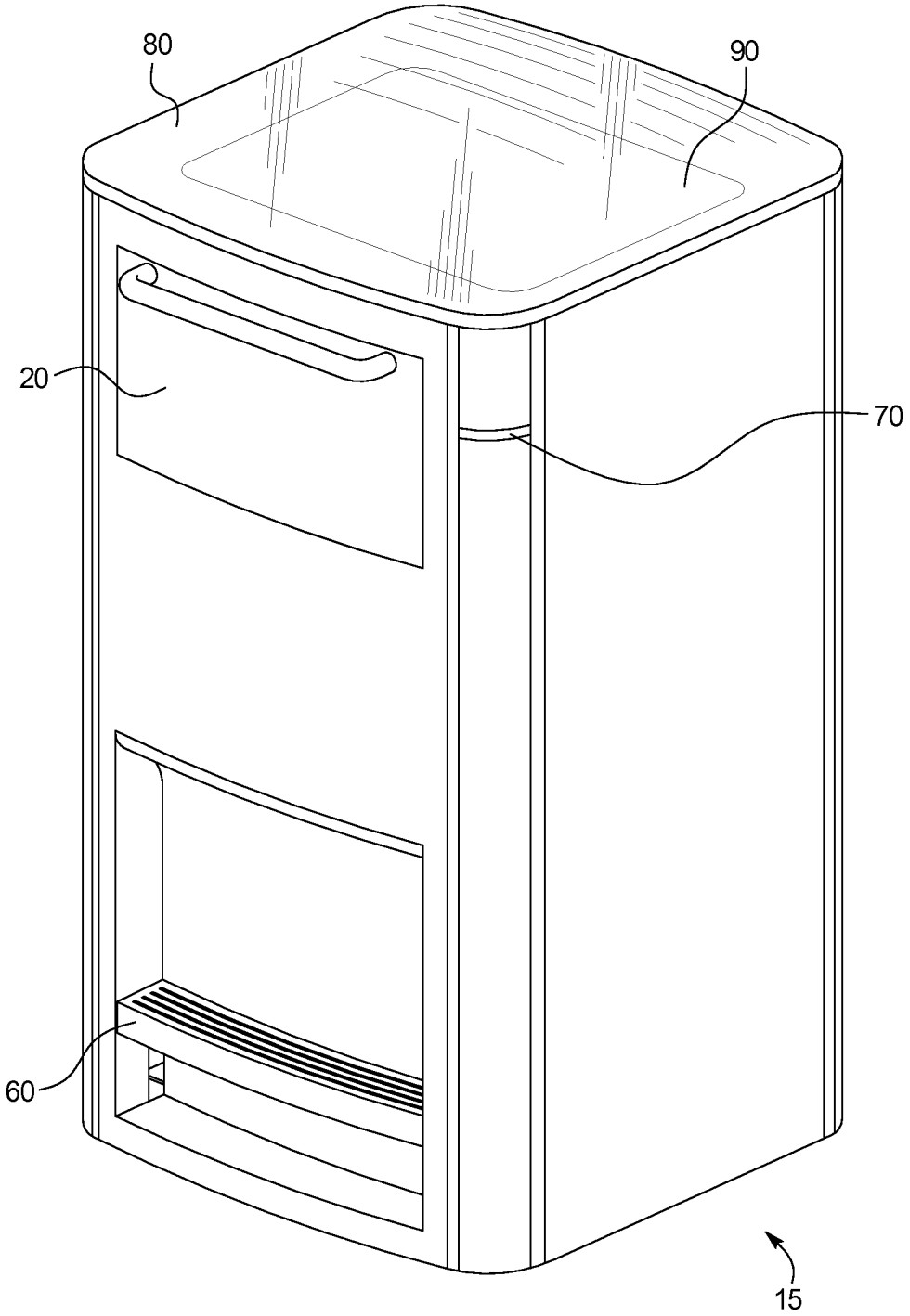
FIG. 1 is a perspective view illustrating an example of a collection apparatus.
Figure 2:
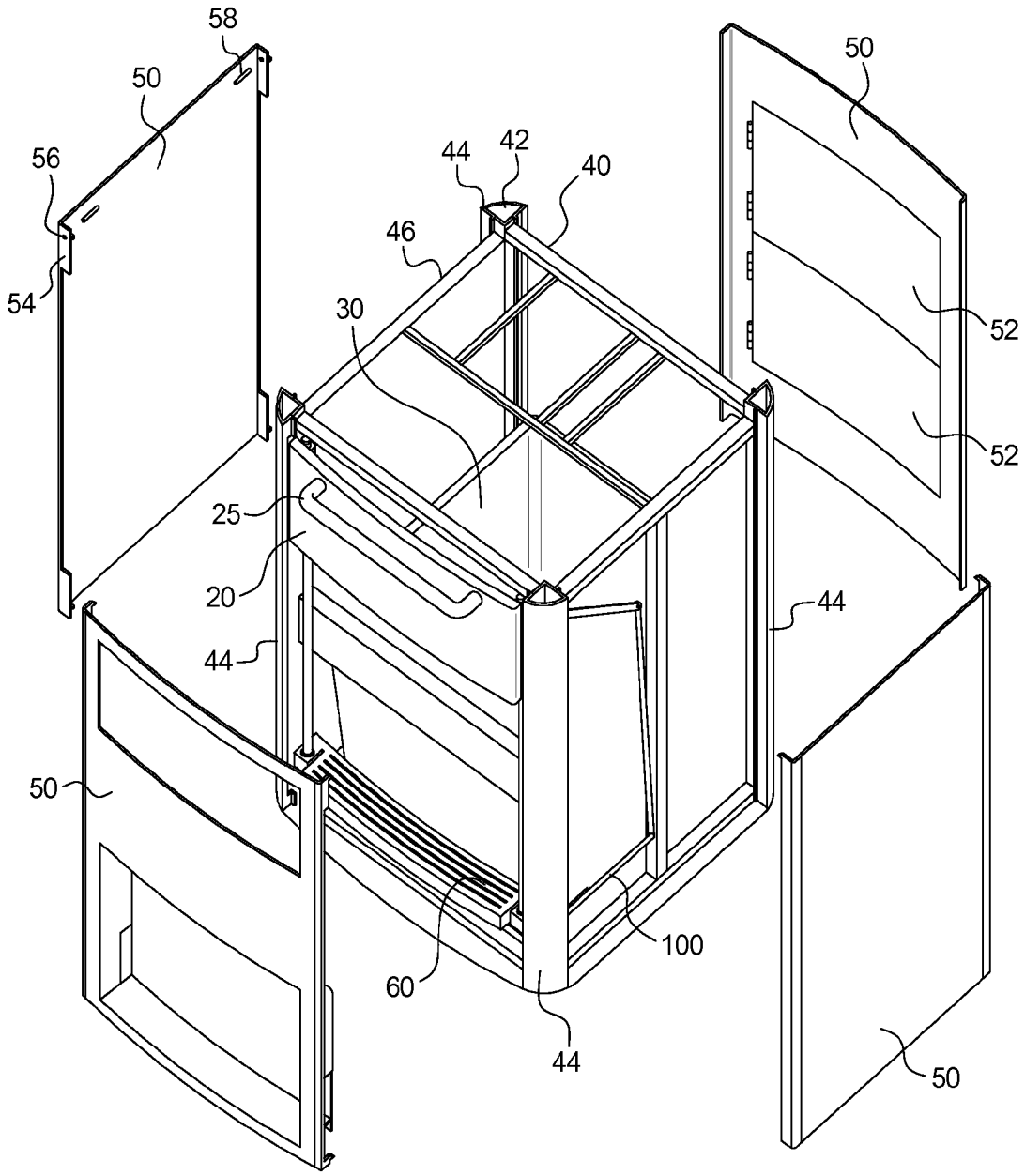
FIG. 2 is an exploded perspective view of the collection apparatus of FIG. 1.

FIG. 1 illustrates an example of a collection apparatus 15. FIG. 2 illustrates an exploded view of the collection apparatus 15 to show its interior. As shown in FIG. 2, the collection apparatus 15 includes a deposit door 20 for receiving collected materials that fall into the collection bin 30. A foot pedal 60 may be included to permit a user to operate the deposit door 20 by foot. One or more indicators 70 may be provided to show the current state of the collection apparatus 15. The collection apparatus 15 may further include a compacting mechanism 400 (FIGS. 7*a*-9). The collection apparatus 15 may include a solar panel 90 mounted at the top or within the collection apparatus 15. The solar panel 90 may be protected from the elements by a cover 80, such as a clear, thermoformed polycarbonate. The solar panel 90 may be adjustable, either manually or electromechanically, to improve sun exposure. Collection and service doors 52 may be provided to permit access to the collected materials for collection by collection workers or to permit servicing of various components of the collection apparatus 15.

In the example shown in FIG. 2, a frame 40 covered by panels 50 structurally defines the collection apparatus 15. The frame 40 may be a box frame 40 constructed of angle irons 42 or other material defining the four corners 44 supported by welded tubes 46 or other material to define the box shape frame of the collection apparatus 15 and provide support to internal structures. In alternate embodiments, the frame may define a circular shape, a rectangular shape, etc. The panels 50 may be interchangeable to permit mounting on various sides of the collection apparatus 15 and to permit varying placement of the collection door 52 or other service and access doors. The panels 50 may have slide hook attachments 54 that secure the panels 50 in place on the collection apparatus 15 and align fastener holes 56 for securing the panels 50 with fasteners 58.

The deposit door 20 of the collection apparatus 15 may provide access to an inlet feeding into the interior of the collection apparatus 15 to deposit the collected materials. The deposit door 20 may include a handle 25. In one embodiment of the deposit door 20 shown in FIGS. 3*a* and 3*b*, the door 10 is a sliding deposit door 10 utilizing a linkage mechanism 100 with a foot pedal 60. In another embodiment shown in FIGS. 4*a* and 4*b*, the deposit door 20 is a sliding deposit door 20 utilizing a pulley mechanism 170 that can be activated by the foot pedal 60. In a further embodiment shown in FIGS. 5*a* and 5*b*, the door 20 is a sliding deposit door 20 utilizing a gear mechanism 230. In yet further embodiments, the deposit door 20 is a swinging deposit door 20 that limits access to the collected materials. In other embodiments, the deposit door 20 may be a chute deposit door, a flip deposit door, an automated flip deposit door, or the deposit door may be omitted.

Figure 3A:
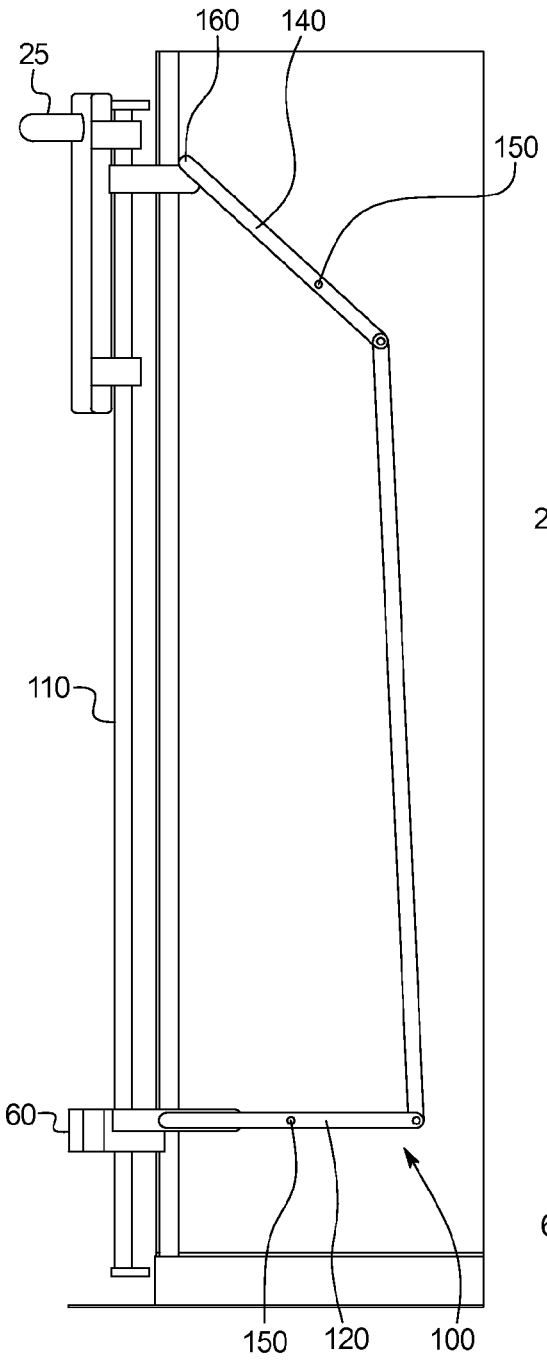
FIG. 3*a* is a cross-sectional view of a portion of a collection apparatus illustrating an example of a closed sliding deposit door utilizing a foot pedal and linkage mechanism.
Figure 3B:
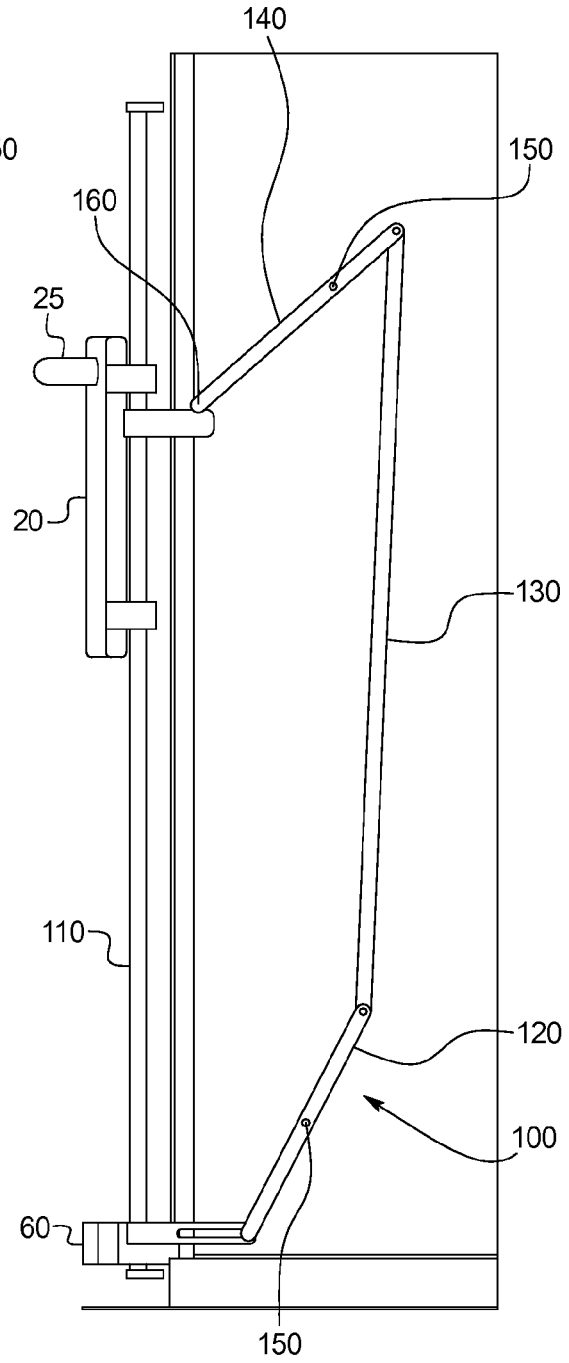
FIG. 3*b* is a cross-sectional view of a portion of a collection apparatus illustrating an example of an open sliding deposit door utilizing a foot pedal and linkage mechanism.

In the sliding deposit door embodiment shown in FIGS. 3*a* and 3*b*, the sliding deposit door 20 is mounted on vertical deposit door tracks 110 on which the deposit door 20 may freely slide vertically. The foot pedal 60 may be connected to the deposit door by a linkage mechanism 100. The linkage mechanism 100 may include a bottom link 120, vertical link 130, and a top link 140. The top link 140 and the bottom link 120 may be fixed at pivot points 150 to translate the vertical motion of the foot pedal 60 into vertical motion of the sliding deposit door 20. The travel ratio between the foot pedal 60 and the sliding door 20 may be customized by appropriate placement of the pivot points 150. Extension springs may be attached to the door 20 and/or the foot pedal 60 to keep the door 20 closed when the foot pedal 60 is not engaged and may used for a softer closing. The linkage interface 160 between the top link 140 and the door 20 may be configured to permit the door 20 to be used independently of the foot pedal 60.

Figure 4A:
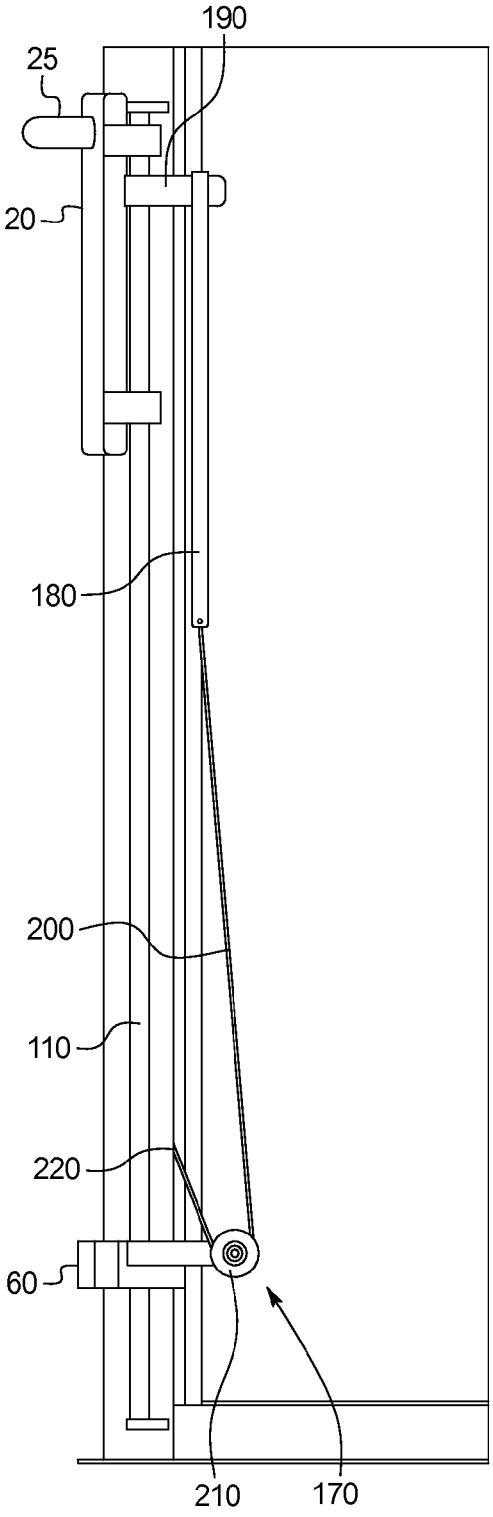
FIG. 4*a* is a cross-sectional view of a portion of a collection apparatus illustrating an example of a closed sliding deposit door utilizing a foot pedal and pulley mechanism.
Figure 4B:
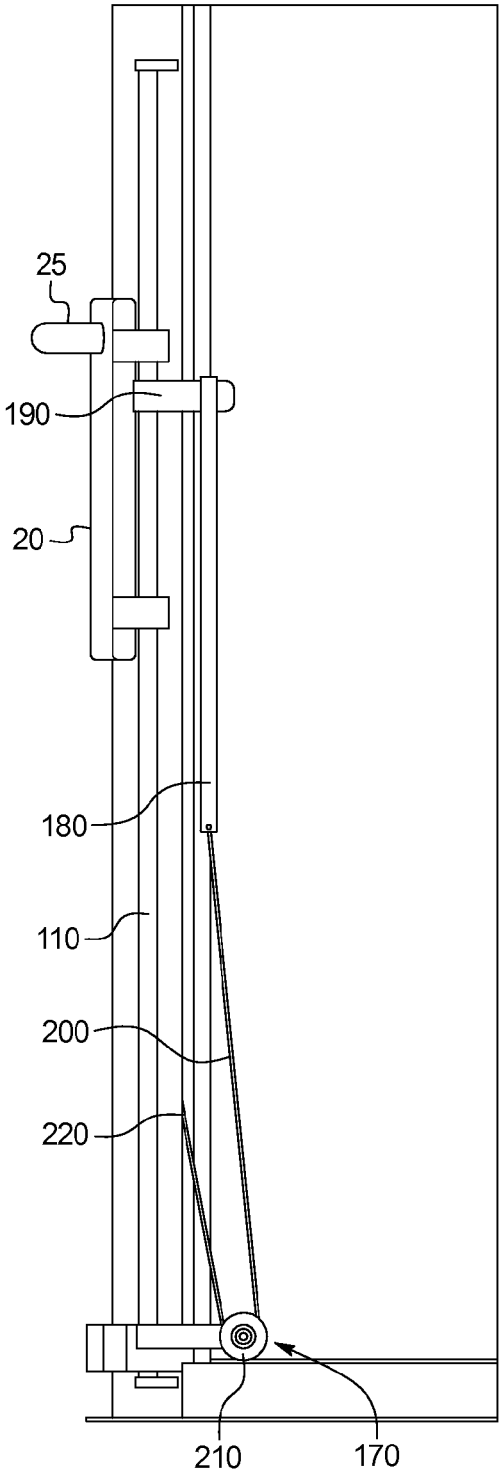
FIG. 4*b* is a cross-sectional view of a portion of a collection apparatus illustrating an example of an open sliding deposit door utilizing a foot pedal and pulley mechanism.

In an alternative embodiment of the sliding door shown in FIGS. 4*a* and 4*b*, the sliding deposit door 20 may be connected to the foot pedal 60 via a pulley system 170. A hook bar 180 may rest on a tab 190 on the deposit door 20 and may be connected to a wire rope 200 wound around a pulley 210 on the foot pedal 60 and affixed to a fixed point 220 on the collection apparatus 15. When the foot pedal 60 is engaged, the motion of the pulley 210 engages the wire rope 200 and hook 180 pulling the deposit door 20 into the open position. The linkage between the hook 180 and the tab 190 need not be fixed to permit the door 20 to be used independently of the pedal 60.

Figure 5A:
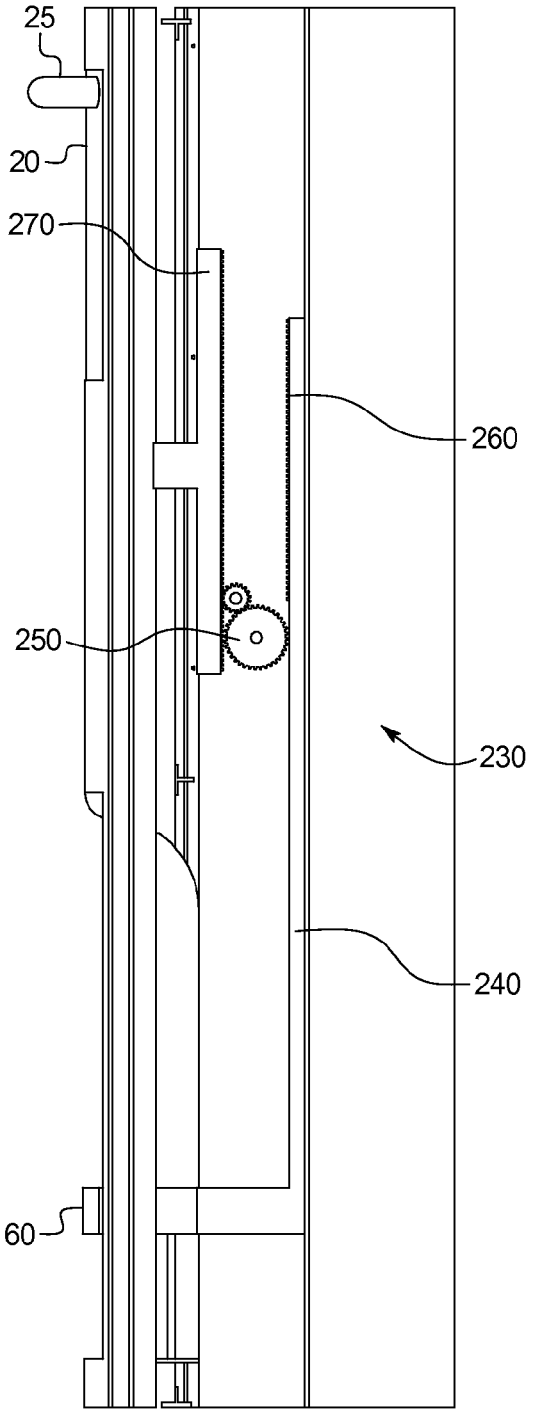
FIG. 5*a* is a cross-sectional view of a portion of a collection apparatus illustrating an example of a closed sliding deposit door utilizing a foot pedal and gear mechanism.
Figure 5B:
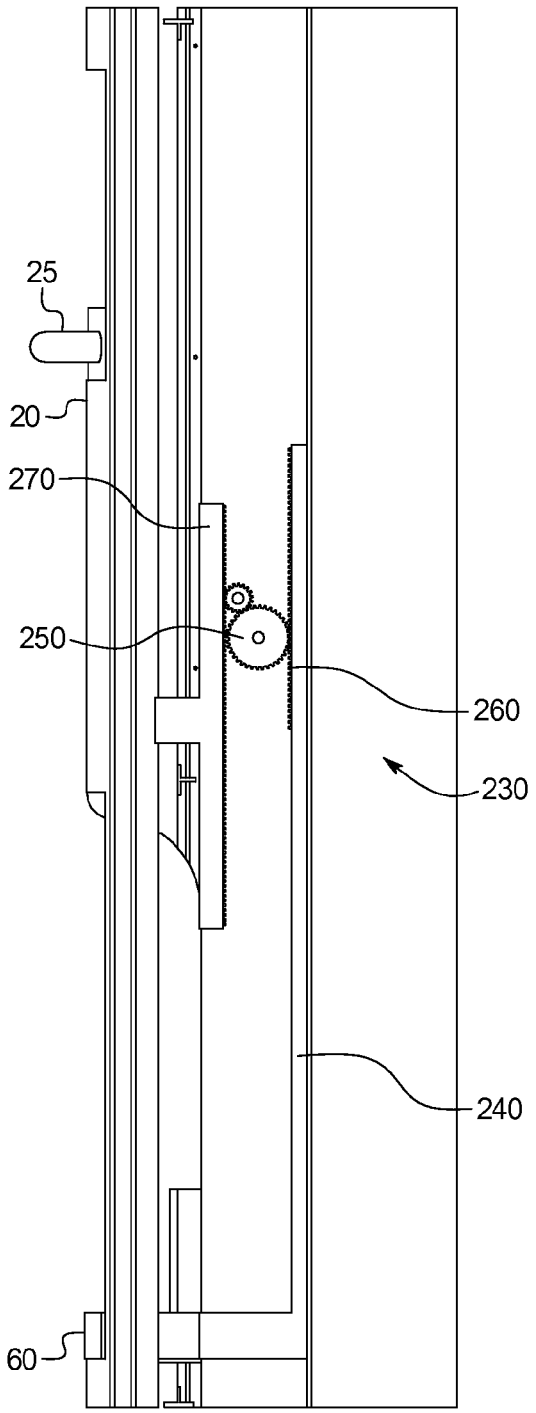
FIG. 5*b* is a cross-sectional view of a portion of a collection apparatus illustrating an example of an open sliding deposit door utilizing a foot pedal and gear mechanism.

In the alternative sliding door embodiment shown in FIGS. 5*a* and 5*b*, the door 20 is a sliding deposit door 20 utilizing a gear mechanism 230. A set of gears 250 are mounted on the collection apparatus 15 and are in contact with a front rack 270 connected to the deposit door 20. The foot pedal 60 is connected to a back rack 240 that has a set of teeth 260. When the door 20 is in the up position shown in FIG. 5*a*, the gears 250 may spin freely in response to motion of the front rack 270, permitting the deposit door 20 to be freely opened by the handle 25. When the foot pedal 60 is engaged, the back rack 240 moves downward and the teeth 260 engage the gears 250 and turn the gears 250 to drive the front rack 270 and the deposit door 20 into the down position shown in FIG. 5*b*.

Figure 6A:
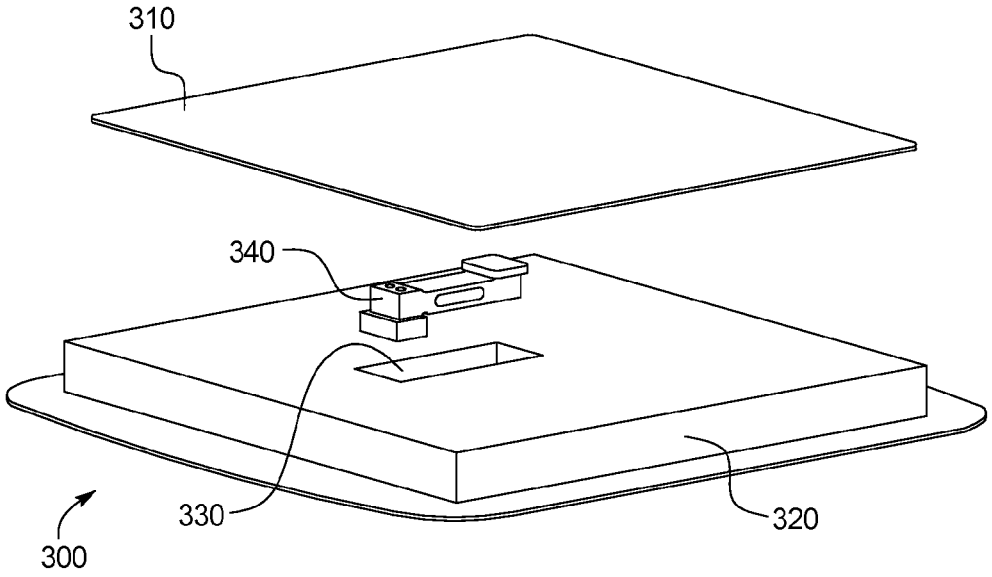
FIG. 6*a* is a perspective view of a weighing system that may be included in the collection apparatus of FIG. 1.
Figure 6B:
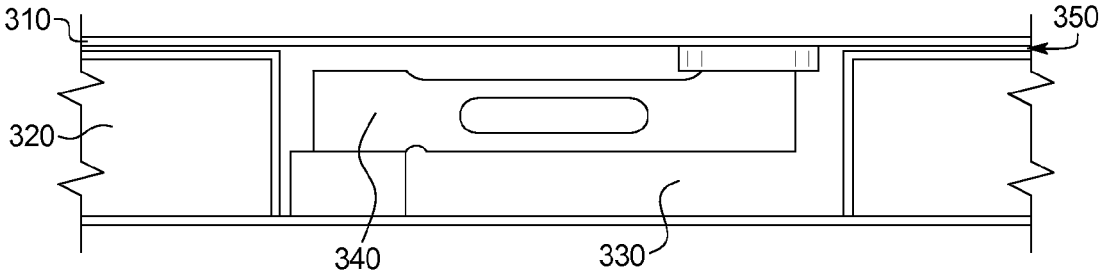
FIG. 6*b* is a cross-sectional view of a weighing system that may be included in the collection apparatus of FIG. 1.

Referring to FIGS. 6*a* and 6*b*, the collection apparatus 15 may include a weighing system 300 beneath the collection bin 30. The weighing system 300 may be a subsystem of a fullness-reporting module 360 (FIGS. 7*a*, 7*b*, and 10) as described below. The collection bin 30 may sit on a bin platform 310 resting above a bottom plate 320. The bottom plate 320 may include a chamber 330 including a weight sensor 340. The bin platform 310, bottom plate 320, and weight sensor 340 may be configured such that when the collection bin 30 is below a predetermined weight limit, the bin platform 310 rests on the weight sensor 340 creating a gap 350 between the bin platform 310 and the bottom plate 320. As the weight in the collection bin 30 increases, or during compaction, the weight sensor 340 deforms causing the gap 350 to shrink until the gap 350 is eliminated at the weight limit. Thus, any excess weight due to overfilling or compaction will be transferred to the bottom plate 320 and, ultimately, the structure of the collection apparatus 15 and not to the weight sensor 340. In alternate embodiments, the weighing system 300 may be a four point scale or any other electronic scale, as will be appreciated by those of ordinary skill in the art from the examples provided herein.

Turning to FIGS. 7*a*-9*b*, the collection apparatus 15 may include a compacting mechanism 400 to compact the collected materials. In one embodiment, the compacting mechanism 400 includes a rack and pinion drive 410 to compact the collected materials. In another embodiment, the compacting mechanism 400 includes a screw drive 420 to compact the collected materials. An internal divider wall may be mounted in the collection apparatus 15 to block access to the compacting mechanism 400 when the deposit door 20 is opened.

Figure 7B:
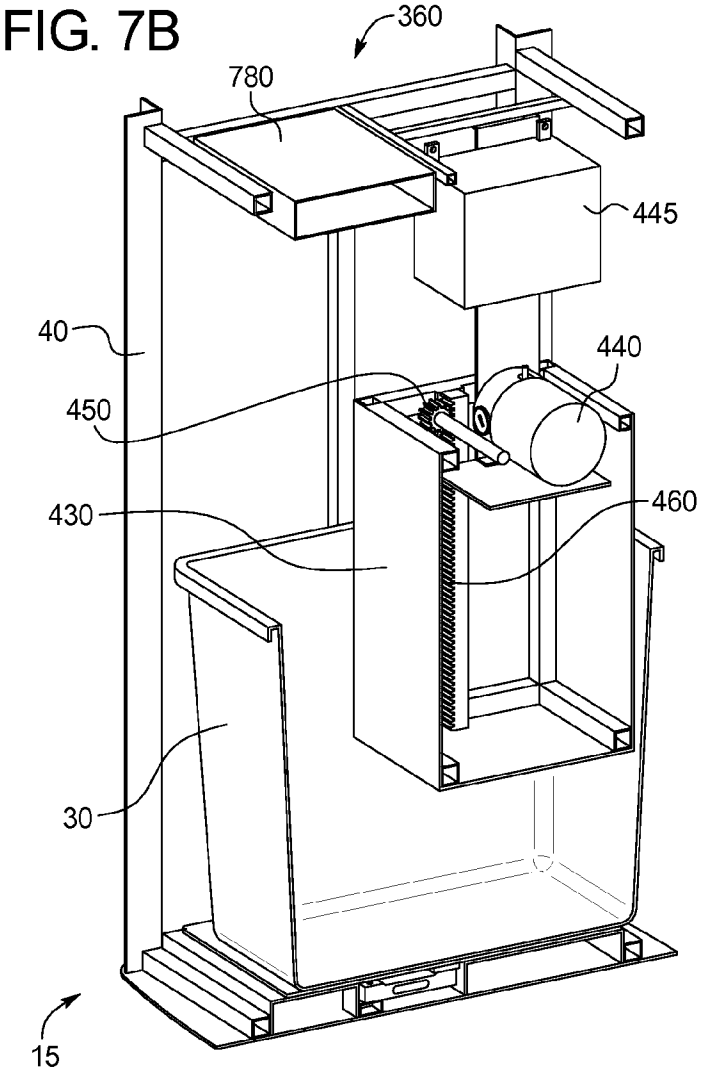
FIG. 7*b* is a perspective cross-sectional view of the fully compacted bottom position of a rack-and-pinion drive embodiment of a compacting mechanism that may be included in the collection apparatus of FIG. 1.
Figure 7A:
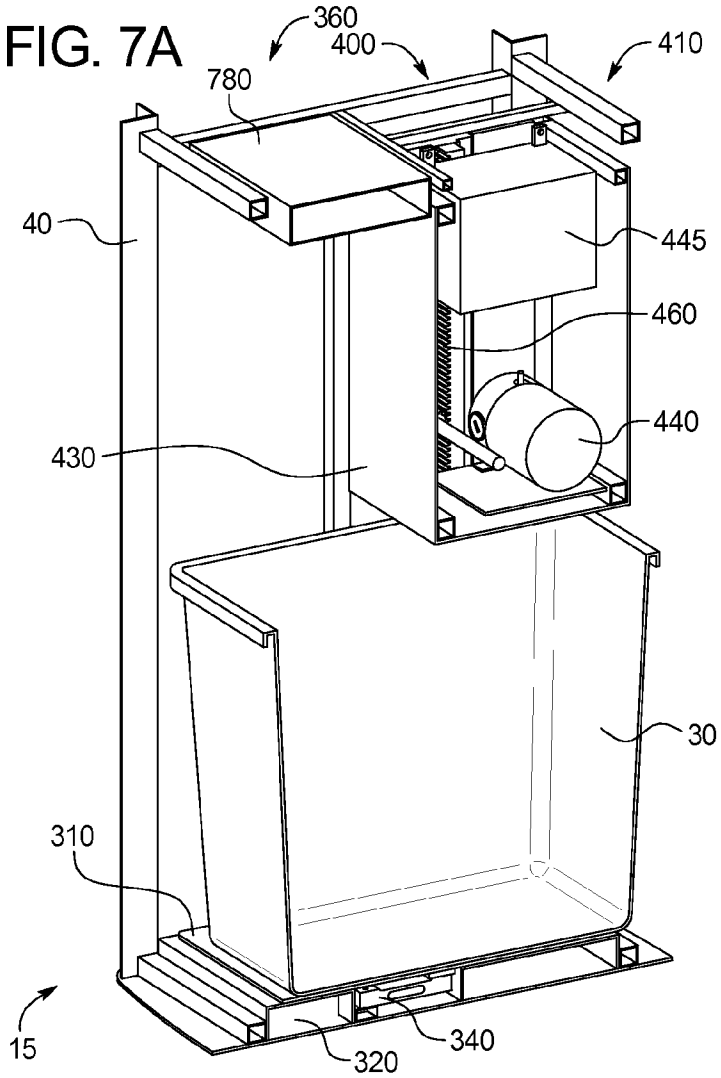
FIG. 7*a* is a perspective cross-sectional view of the home position of a rack-and-pinion drive embodiment of a compacting mechanism that may be included in the collection apparatus of FIG. 1.

In rack-and-pinion drive embodiment show in FIGS. 7*a* and 7*b*, the compacting mechanism 400 comprises a ram body 430 driven by a motor 440 using rack-and-pinion gears. The motor 440 drives a pinion gear 450 that meshes with the rack gears 460 to drive the ram body 430 into the collection bin 30 to compact the collected materials. The ram body 430 may fully encompass the motor 440, the pinion gear 450, and the rack gear 460 to shield them from any debris.

In the embodiment shown in FIG. 7*a*, in the home position, the bottom of the ram body 430 is approximately twenty-four and a quarter inches above the bottom of the collection apparatus 15, and, in the fully-compacted bottom position shown in FIG. 7*b*, the bottom of the ram body 430 is approximately eleven inches from the bottom of the collection apparatus 15. Further, the rack gears 460 are mounted inside the ram body 430 and the motor 440 and pinion gears 450 may be mounted to the main frame 40 of the collection apparatus 15.

In alternative embodiments, the rack gears 460 may be mounted outside of the ram body 430 on the main frame 40 of the apparatus. The motor 440 may be mounted in the ram body 430 and move with the ram body 430 during compaction. By using rack gears 460 mounted outside of the ram body 430, the ram body 430 may start in a higher position.

Figure 8:
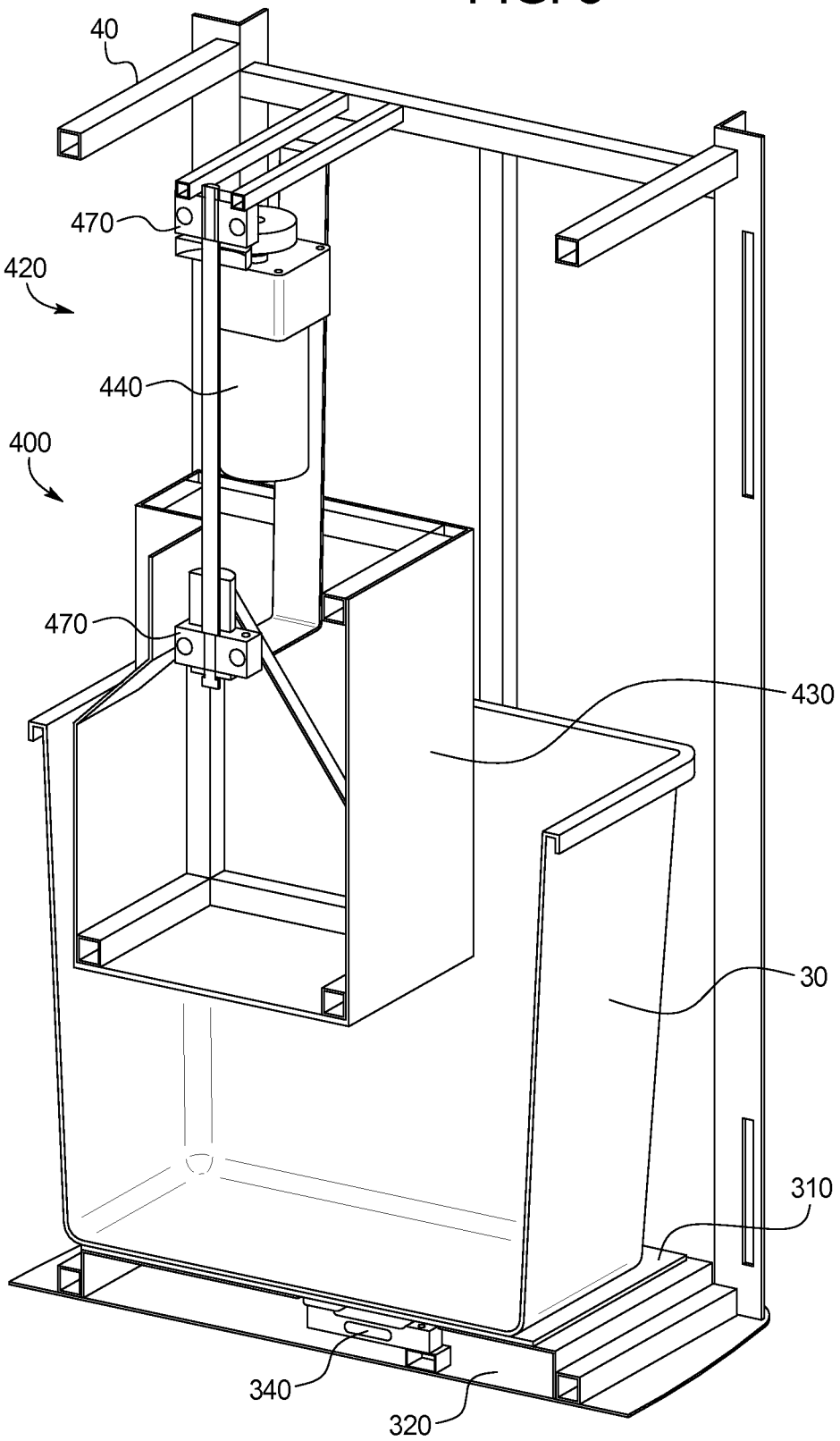
FIG. 8 is a perspective cross-sectional view of the fully compacted bottom position of a screw drive embodiment of a compacting mechanism that may be included in the collection apparatus of FIG. 1.

In the compacting screw drive embodiment shown in FIG. 8, the motor 440 of the compacting screw drive 420 is mounted to the frame 40. Support blocks 470 support a guide shaft 480 mechanically connected to the motor 440. The ram body 430 may be mounted on the guide shaft 480. As the motor 440 rotates the guide shaft 480, the ram body 430 is lowered to drive compaction. Using a compacting screw drive 420 minimizes the exposure of the mechanical components to the collected materials. Additionally, the compacting screw drive 420 is a proven technology that is widely used in residential compactors. However, the single guide shaft 480 may have stability issues when fully lowered that lead to jams.

Figure 9A:
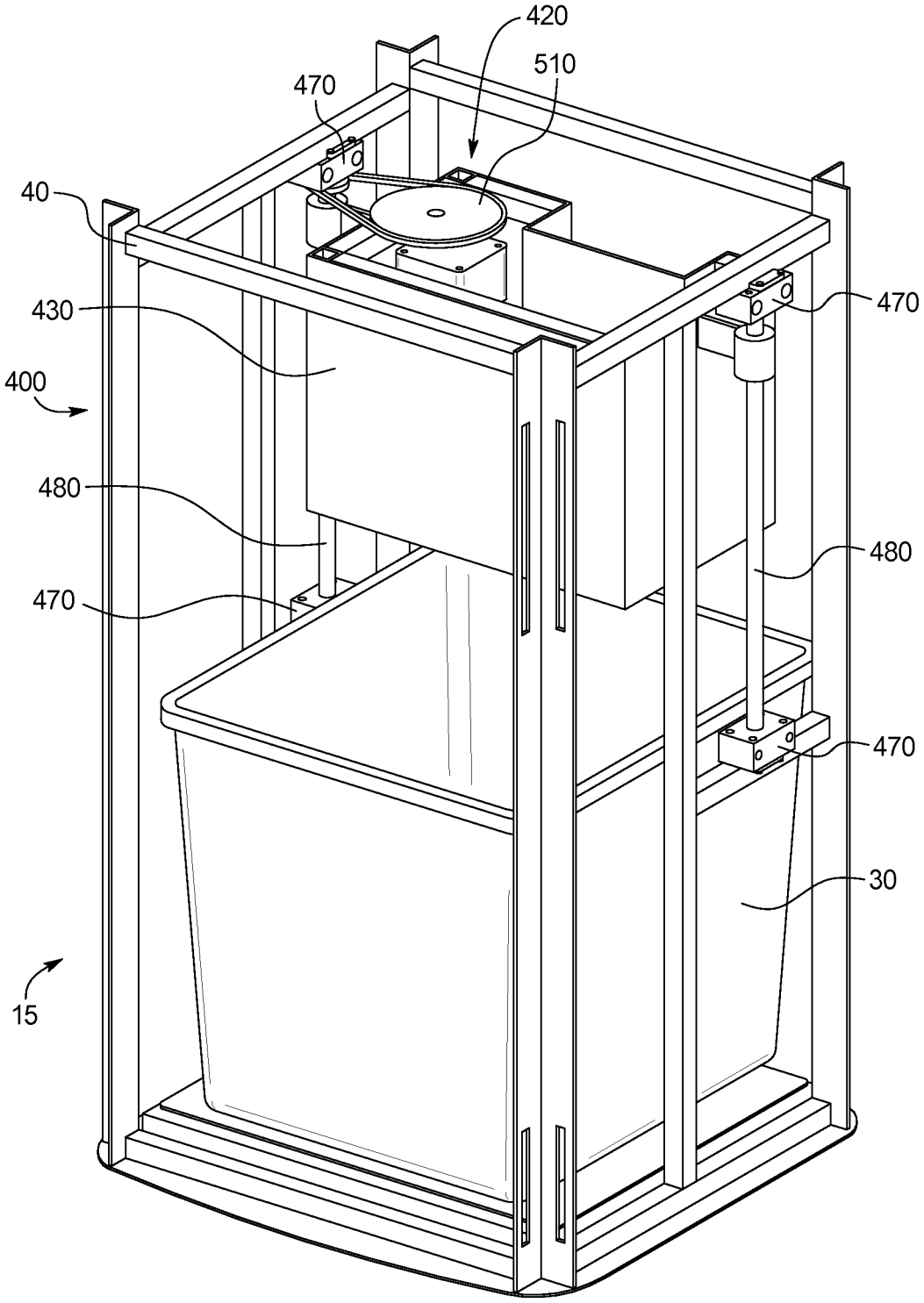
FIG. 9*a* is a perspective cross-sectional view of the home position of an alternative screw drive embodiment of a compacting mechanism that may be included in the collection apparatus of FIG. 1.
Figure 9B:
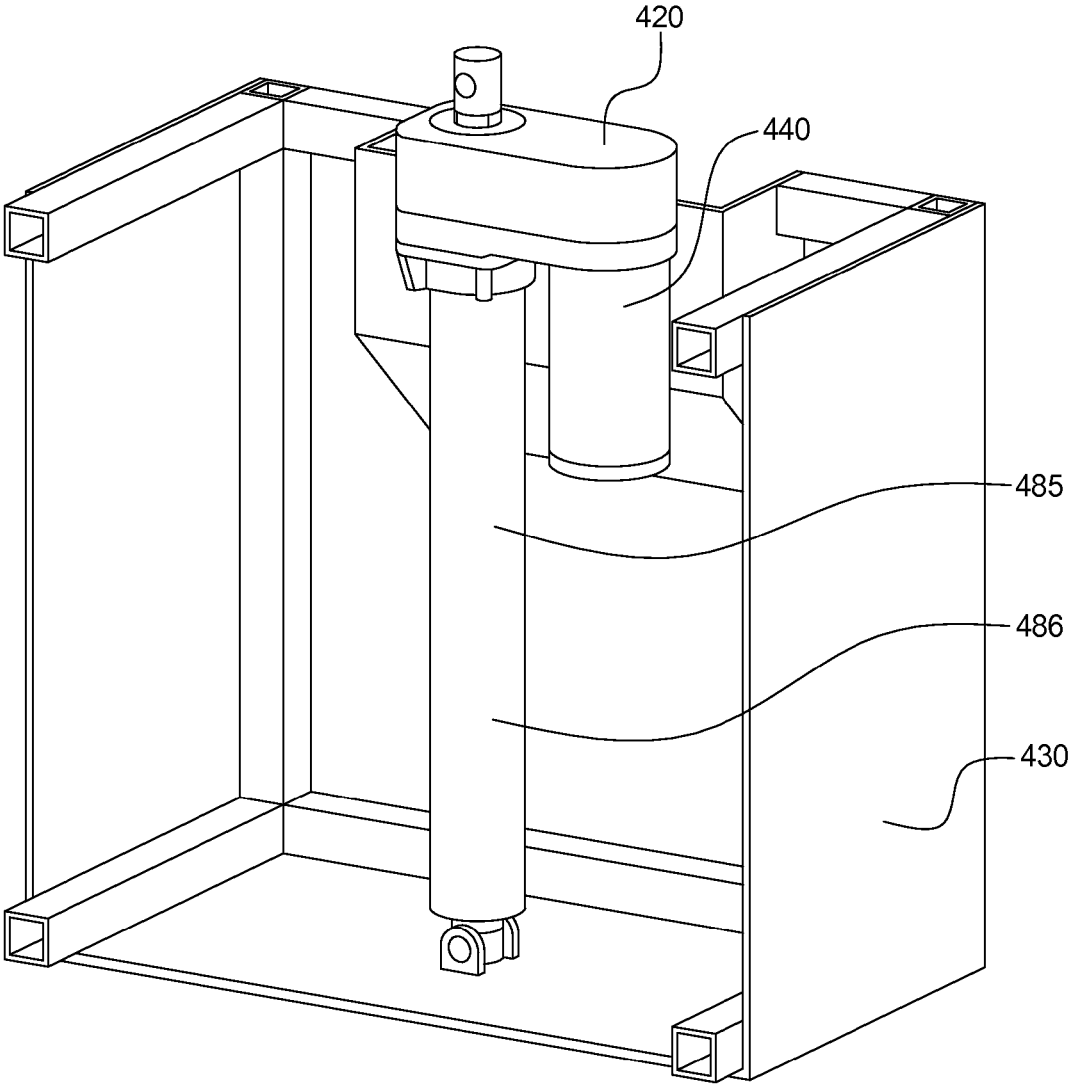
FIG. 9*b* is a perspective cross-sectional view of another alternative screw drive embodiment of a compacting mechanism that may be included in the collection apparatus of FIG. 1.

In an alternate version of the screw drive 420 shown in FIG. 9A, multiple guide shafts 480 are used to provide increased stability and align ram body motion. The inner walls of the collection apparatus 15 may include slots to accommodate the supports shafts 480. A chain drive 510 may be used to drive a guide shaft 480. In some embodiments, additional barriers may be provided to prevent garbage ingress. In another alternate version of the screw drive 420 shown in FIG. 9B, the screw drive 420 is a screw-type actuator 420 with a screw guide shaft 480 that drives a sliding tube 485 contained within the cylinder 486 that drives the ram body 430.

Figure 10:
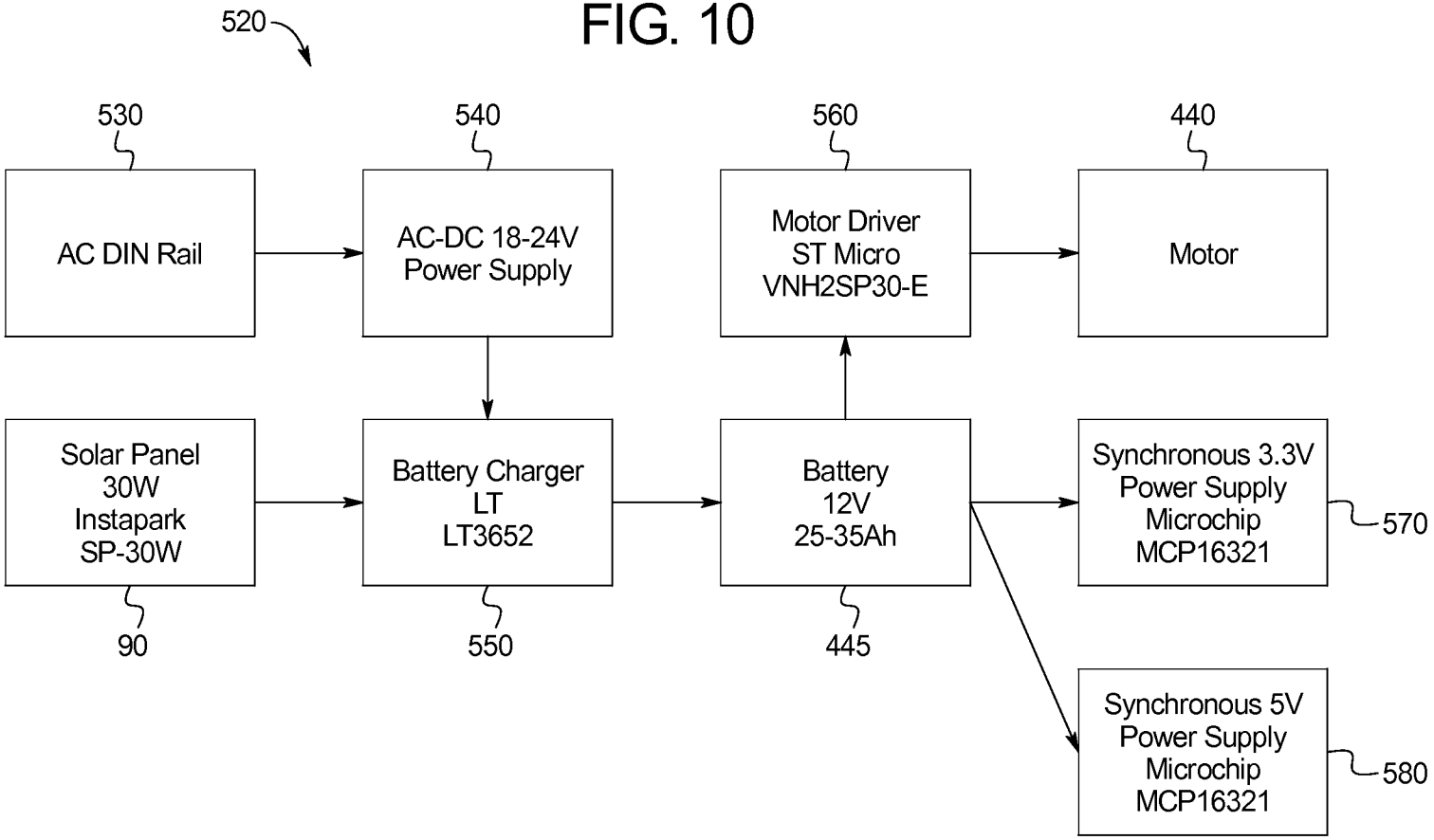
FIG. 10 is a block diagram illustrating an example implementation of a power system architecture to provide the functionality of the collection apparatus.

The collection apparatus 15 is electrically powered. FIG. 10 is a block diagram illustrating an example implementation of a power system architecture 520 that provides the functionality of the collection apparatus 15 described herein. The collection apparatus 15 may use grid power, solar power, or a combination of both. Electricity may be received at an electrical input 530 and passed into a power supply 540. The power supply 540 may power a battery charger 550 that may also receive electricity from the solar panel 90, such as a 30W monocrystalline solar panel. The battery charger 550 may charge a battery 445 to store electrical power for later use. The battery 445 may power the various functionalities of the collection apparatus 15. In a preferred embodiment, the battery is a 12-volt battery with twenty-six to thirty-five amp-hour of energy storage and the battery charger is a Linear Technology LT3652. A motor drive 560 may be connected to the battery 445 to drive the motor 440 of the compacting mechanism 400. In a preferred embodiment, the motor driver is a ST Micro VNH2SP30-E that may include integrated current sensing. The battery 445 may further power a 3.3 volt power supply microchip 570 and a 5 volt power supply microchip 580 that provide power to the control system architecture 600

Figure 11:
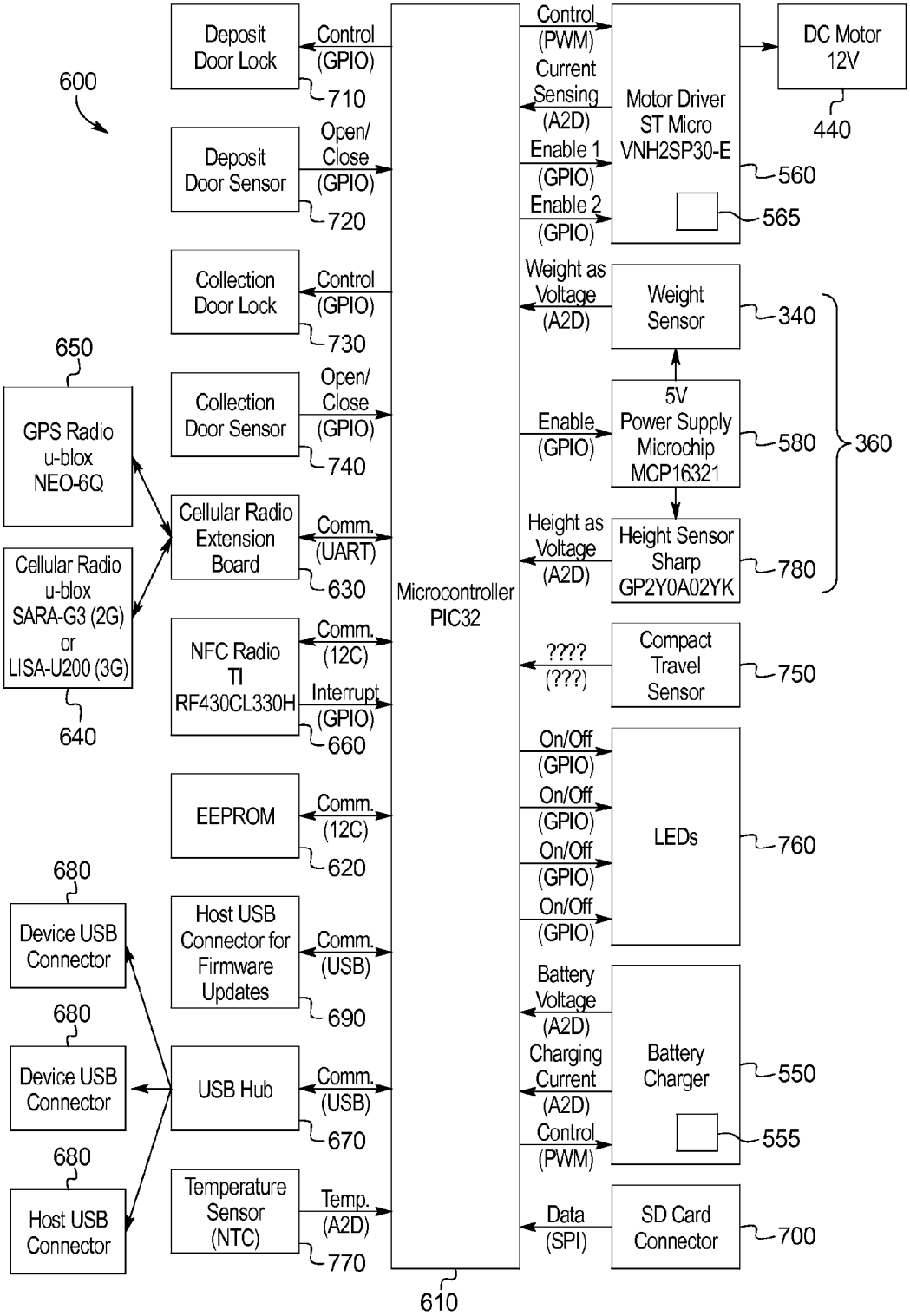
FIG. 11 is a block diagram illustrating an example implementation of a control system architecture to provide the functionality of the collection apparatus.

FIG. 11 is a block diagram illustrating an example implementation of a control system architecture 600 that provides the functionality of the collection apparatus 15 described herein. The collection apparatus 15 includes a controller 610, in this example, a microcontroller, to coordinate and control the control system architecture 600. Instructions and data may be stored in one or more memories 620. For example, an EEPROM memory 620 may permit the non-volatile storage of instructions and data. In some embodiments, the control system architecture 600 and associated components may be provided as a separate device assembly to permit retrofitting of existing collection apparatuses 10.

As described above, to permit measurement of the weight and fullness of the collection device 15, the collection apparatus may include a fullness-reporting module 360. The fullness-reporting module 360 may include a weight sensor 340 and/or a height sensor 780 to measure the weight and/or fullness of the collected materials. The weight sensor 340 may be a load cell, or in alternate embodiments, a bench scale platform. The fullness sensor 780 may be an ultrasound sensor, laser distance measurement device, or a combination of ultrasound and laser distance measurement devices mounted to the top of the collection bin 30 to measure the current height of the collected materials. In some embodiments, multiple height sensors 780 may be used to make multiple height measurements at various points to prevent uneven distribution of the collected materials from incorrectly indicating an incorrect fullness level. Some examples of infrared sensors 780 that may be used in some embodiments of the collection apparatus are Sharp Microelectronics models: GP2D12J0000F, GP2Y0A21YK0F, GP2D120XJ00F, GP2D15J0000F, GP2Y0D21YK0F, GP2D150AJ00F, GP2Y0D805Z0F, GP2Y0D810Z0F, GP2Y0D02YK0F, GP2Y0A02YK0F, GP2Y0A700K0F. The fullness reporting module 360 may be provided as single module that communicates with the controller 610 or may be provided as several fullness reporting subsystems controlled by the controller 610 using fullness reporting instructions.

Figure 13:
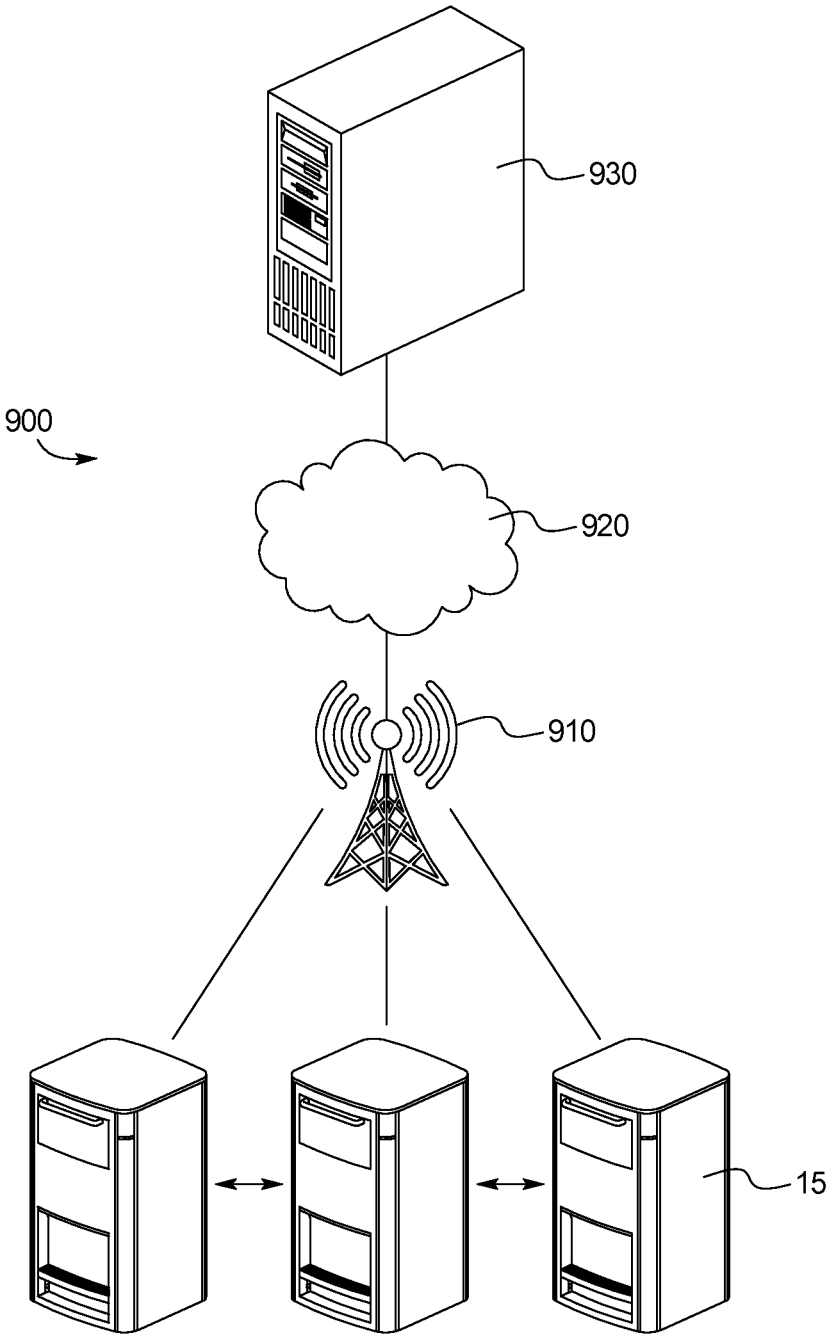
FIG. 13 illustrates the communications ecosystem of the collection apparatuses.

Referring to FIG. 13, one or more collection apparatuses 15 may communicate with remote servers 930. In the embodiment shown, the collection apparatuses 15 access a communications network 920, such as the Internet, via cellular towers 910 to communicate with the remote server 15. The collection apparatuses 15 may communicate data to the remote servers 930, provide remote control of the collection apparatus 15, to receive system updates, and carry out other tasks. Any information collected by the controller 15, fullness reporting module 360, and any sensors in collection apparatus 15 may be communicated to the remote server 15.

The collection apparatus 15 may include a wireless communications module 630 to communicate data to the remote servers 930 and a location services module. For example, the wireless communications module 630 may include a cellular radio extension board 630 that provides interoperability with a cellular radio 640 and/or a GPS radio 650. Cellular radio 640 may be used to communicate with remote server 930. GPS radio 650 may be used to locate the collection apparatus 15 and transmit the location to the remote server 930, functionality that may be especially useful for temporary or movable collection apparatuses 15. In some embodiments, the collection device 15 may have a wired connection to communication networks 920. It is contemplated that the collection apparatus may include any form of wired or wireless communication to communicate with remote servers 930 as will be understood by those of ordinary skill in the art.

The collection apparatus 15 may also include various communications subsystems to communicate with nearby systems. For example, near-field radio communications 660, such as Bluetooth or Wi-Fi, may be provided for local communication to enable, for example, service workers for access and/or control, or to enable interaction with an access key card for locking or unlocking. Additionally, in some embodiments, collection apparatuses 15 may communicate with other collection apparatuses 15 or nearby devices, such as phones, laptops, tablets, etc., using machine-to-machine communications to form wireless mesh networks, share internet access, forward reporting communications, or otherwise provide the functionality described herein. Further, in some embodiments, the collection device 15 may provide Internet access to nearby users via Wi-Fi or other communication protocols.

The collection apparatus 15 may have internally and externally-accessible USB ports to permit communication with the collection device 15. A USB Hub 670 may be connected to the controller to permit communication with various USB ports 680. Likewise, a host USB connector 690 may be provided for firmware updates. Additionally, an SD card connector 700 may permit the manual transfer of instructions and data to and from the compaction apparatus with an SD card. In some embodiments, the USB ports of the collection device 15 may be accessible by the public to permit charging of user electronic devices. It is contemplated that USB ports 680 are merely one example of power and/or communication ports that may be provided through the collection device 15.

A deposit door lock 710 may lock the collection apparatus when full, as required for safety, or when in need of servicing. The controller 610 may unlock the deposit door lock 710 in response to a remote signal received by the communications system, or a local signal as may be received via near-field communication. A deposit door sensor 720 may detect when the deposit door 20 is opened. A collection door lock 730 may selectively provide collection workers access to the collected materials via the collection and service doors 52 or to permit servicing. A collection door sensor 740 may monitor the collection door 52 and notify the collection organization of when the collected materials were collected and by whom and/or if the collection door 52 is opened without authorization. The deposit door lock 710, the collection door lock 730 and any other electronic locks may be remotely controlled and may provide keyless lock entry. In other embodiments, manual locks may be provided in addition to, or in substitution or as secondary release for electronic locks, as will be understood by one of ordinary skill in the art.

The controller 610 may control compaction via a motor driver 560 connected to the DC motor 440 of the compacting mechanism 400. The motor driver may include a compaction motor load sensor 565, such as a motor electrical current sensor, to measure the load on the motor during a compaction cycle. A compactor travel sensor 750 may be provided to determine when the ram body 430 is fully extended. The controller 610 may combine information from various sensors and electronics, such as the fullness reporting module 360, the power supply 580, the compactor travel sensor 750, the motor driver 560 compaction motor load sensor 565, etc., to tailor compaction functionality to existing circumstances.

For example, to optimize use of available power, the controller 610 may optimize compaction to use less energy. The controller 610 utilizes the material height information from the fullness-reporting module 360 to optimize the compactor ram travel. In one example, when the controller 610 determines that the height of the material is low, the ram body 430 is not brought to its home position but instead, is left slightly above the material. The next compaction cycle will only need to move the ram body 430 a slight amount to come into contact with the material. This approach reduces return travel after compaction and initial travel at the start of a cycle, thus saving power.

Another technique the may be used by the controller 610 to save compactor energy is to limit the compaction pressure applied. The load on the motor 440 is monitored during each compaction cycle by the compaction motor load sensor 565 and the controller 610 records the amount of compaction that can be obtained using the fullness reporting module 360. Attempting to drive the ram to its full length when the material is dense and cannot be compacted further just wastes energy. Thus, the controller 610 uses the height of the material and the previous compaction load to determine a compaction pressure to compact the newly added material.

The weight sensor 340 of the fullness-reporting module 360 may also used to optimize compaction. The operator of the unit may preprogram a maximum weight that can exist in the collection apparatus 15 before it must be emptied. As material is added to the collection apparatus 15, the weight sensor 340 measures the weight. If the weight reaches the maximum weight, then the controller 610 suspends compaction cycle activity so as to not overfill the collection apparatus 15. The controller 610 may then activate the deposit door lock 710 to lock the device from further collections, and activate an indicator 70 to indicate the collection apparatus 15 is full. At this point, due to the communications from the collection apparatus 15 to the remote server 930, it is likely that a collection worker will soon empty the collection apparatus 15.

The controller 610 may communicate with the battery charger 550 to determine current battery energy levels using a battery charge level sensor 555. If battery energy levels are below programmed thresholds, the controller 610 may disable the motor 440, power off some or all of the electronic functions of the collection apparatus 15, send a notification to a remote server 930, activate an indicator 70, and/or otherwise notify users, collection workers, and/or the collection organization. The battery charge level threshold may be the level needed to adequately run a subsequent compaction cycle, a fixed percentage of the total charge level, such as 10%, or an amount of charge equal to the solar power received during a period of time. Further, in response to low battery energy levels, the controller 610 may switch to an intermediate compaction mode to conserve energy. It is important to note that the collection apparatus 15 is not designed to skip a compaction cycle in response to a low power condition.

Sensors, devices, and additional subsystems may be coupled to the controller 610 to facilitate various functionalities. For example, subsystems may be provided to monitor the quality and condition of the collected materials. As example, a temperature sensor 770 may be provided to determine the likelihood of unsafe bacterial growth in the collected materials, spoilage, fouling of the collected materials, or other temperature-related issues. Measured temperatures may be communicated to a remote server 930 to permit monitoring of the collection apparatus conditions. As yet another example, the controller 610 may control air freshening devices to reduce the effects of unpleasing odors caused by the collected materials. Moreover, air quality sensors may be provided to permit quality readings to be reported to the remote servers 930. Where the collected materials are expected to attract vermin, insect repellents, rodent repellents, etc., may be provided to prevent infestation. Some examples include poisons, sonic repellents, and other electronic and non-electronic repellents.

Likewise, the collection device 15 may include subsystems for providing security to the area around the device and to protect the device. For example, a camera may be provided in the collection device 15 to permit remote imaging of the environment surrounding the collection device 15 for security and other purposes. As another example, an accelerometer may be provided to enable orientation and motion tasks, such as, determining whether the device has been tipped.

The controller 610 may communicate weight and fullness readings to a remote server 930 at scheduled times, upon opening or closing of the deposit door 20, after a compaction cycle, in response to a remote query, etc. The remote server 930 may store the weight and fullness measurements along with the location of collection apparatus 15 in a memory of the remote server 930. The remote server 930 may use the weight and fullness measurements and location information of various collection apparatuses 15 to generate a collection schedule for the collection of collected materials by collection workers. Additionally, the current level of compaction may be transmitted to a remote server 930 periodically, after a compaction cycle, at the request of the remote server 930, or at any other useful time.

The collection apparatus 15 may include various indicators 70 to indicate the current state of the collection apparatus 70. For example, the collection apparatus 15 may include a fullness indicator 70 to indicate that the collection apparatus 15 is full and may no longer receive collections. As another example, a low battery indicator 70 may indicate that the stored electrical energy in the battery 445 has gone below a threshold. As an additional example, a collection door indicator 70 may blink when the collection door 52 is not closed. The indicators may be LED lights 760 mounted in the body of the collection apparatus. The LED lights 760 may be disabled as needed to conserve energy and extend battery life. The fullness indicator may be an LED light 760 with the word "FULL" inscribed in the LED cover lens to indicate to the user why the deposit door 20 is locked. In an embodiment, duplicate indicators 70 may be provided on one or more faces, edges, or all faces, to permit easy viewing of the state of the collection apparatus 70.

The collection apparatus 15 may further include an advertising panel mounted on one or more of the panels 50. The advertising panel may be digital or print. The collection apparatus 15 may include lights that light the advertising panel. For digital ad panels, the controller 610 may control the display of advertising on the panel, and may provide user interaction.

The collection apparatus 15 may be mounted on a spike system 800 that may be used to secure items such as the collection apparatus 15 to the ground. The spike system 800 may be used to lock down both permanent and temporary installations. It is contemplated, however, that the spike system 800 may be used to secure any outdoor apparatus, equipment, furniture, and other mostly permanent items to the ground. Further, the spike system 800 may be used to help hold down in place non-permanent items such as wheeled carts.

Figure 12:
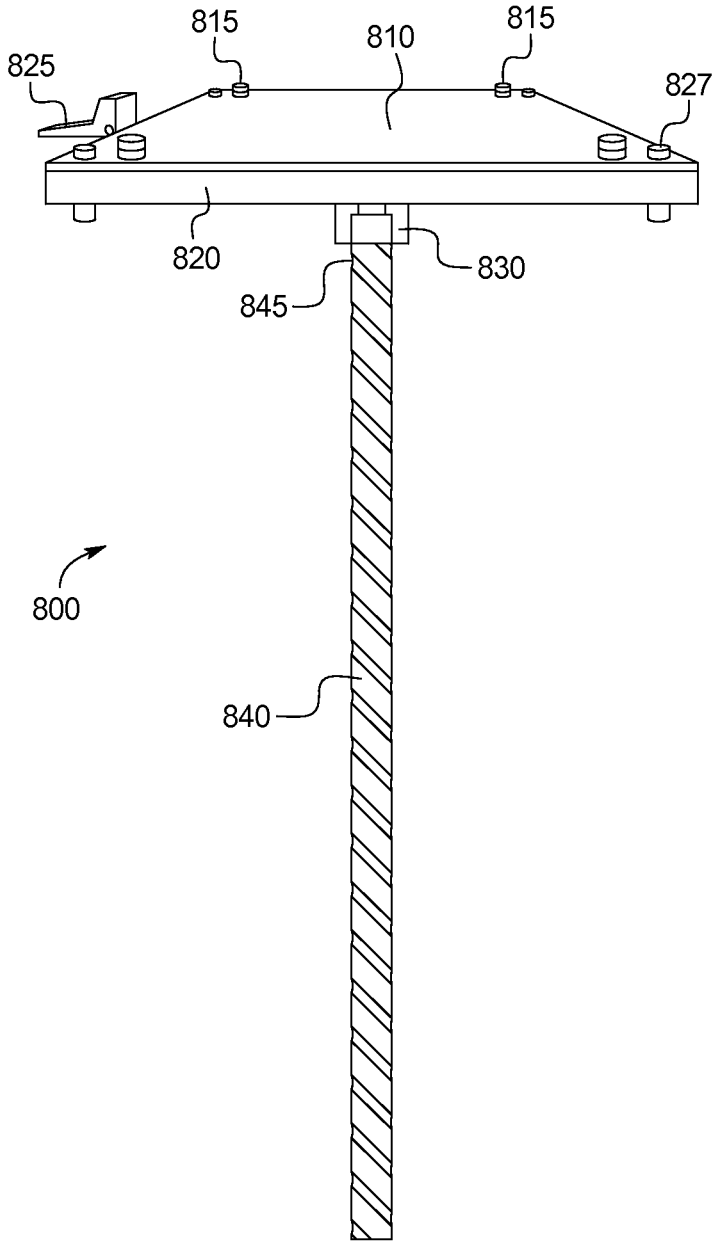
FIG. 12 illustrates an example of a spike system for securing items, such as the collection apparatus of FIG. 1, to the ground.

FIG. 12 illustrates an example of the spike system 800. As shown in FIG. 12, the spike system 800 may include a top plate 810, a plate 820, an optional lock-on cap 830, a spike 840, and an optional protective cap (not shown). In some embodiments, multiple spikes 840 may be provided to strengthen the attachment to the ground. The top end of a spike 840 may include an auger adapter 845 to permit easy installation using an auger motor. It is contemplated that the length of the spike may be varied to increase the permanence of the spike system 800. For example, in an embodiment, the spike 840 is provided at a length sufficient to reach from the surface to below the frost line. In less permanent embodiments, the length may be half of the length sufficient to reach from the surface to below the frost line.

To install the spike system 800, the spike 840 is drilled into the ground with a drill such as an auger motor or manual drilling system. The spike 840 may then be detached from the auger motor or manual drilling system and attached to the plate 820 either directly or using the optional lock-on cap 830. The plate 820 may include stabilizers 827 that may be adjusted to level the plate 820 to provide a level platform to secure items on. In the example shown in FIG. 12, the stabilizers 827 are adjustable legs that can be screwed up or down from the plate 820 to level the spike system 800. After the plate 820 is attached, a customized top plate 810 may then be mounted onto the plate 820, if needed, for attachment of products not designed to attach directly to the top plate 810. The plate 820 may couple with a variety of different configurations of top plates 810 to permit the attachment of items with a variety of attachment mechanisms to the top plate 810. It is contemplated that top plates 810 may be stacked to increase height, provide other attachment mechanisms, etc. If an item is not placed after installation, a protective cap may be placed on the top plate 810 or plate 820, to protect the spike system 800.

In the example shown in FIG. 12, the top plate 810 includes a series of quick-release attachments 815 for mounting the collection apparatus 15. After installation, the secured item, such as the collection apparatus 15, may then be removably mounted on the spike system 800 using the quick-release attachments 815. The quick-release attachments 815 may be operated using a foot release latch mechanism 825, as shown in FIG. 12. Additional locking mechanisms may be used to further secure the object to the spike system 800. For example, the top plate 810 may include a latch that may include a lock with a release to removably secure the collection apparatus 15 to the spike system 800. As noted, the top plate 810 shown in FIG. 12 may be adapted for securing a collection apparatus 15. However, in another embodiment, a different top plate 810 may be used to permit other items, such as wheeled carts, to be attached to the spike system 800.

As described, the spike system 800 may permit easy removal of attached items. While shown on the top plate

810, the plate 820 and/or top plate 810 may include quick-release attachments 815 using screws, cam locks, magnets, latch, or other fasteners, as attachment mechanisms for attached items. As noted, the foot release latch mechanism 825 may actuate the quick-release attachments 815 to permit the removal of the attached items.

The spike system 800 may be configured for easy removal involving the steps of removing the top plate 810, if present, removing the plate 820 from the lock-on cap 830 or spike 840, attaching the spike 840 to the auger motor or manual drilling system, and drilling in the reverse to remove the spike 840.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A collection apparatus weight and fullness level reporting system comprising:

an inlet providing passage to the interior of the collection apparatus;

a removable collection bin receiving material placed into the collection apparatus through the inlet;

a compacting mechanism including a ram body, wherein the ram body travels along a compaction path between a home position located above the collection bin to a maximum travel position located inside the collection bin, wherein during each compaction cycle the ram body travels along a variable length of the compaction path;

a fullness-reporting module including a height sensor that determines the height of the material in the collection bin; and a controller receiving input from the fullness reporting module and controlling the travel of the ram body, wherein the controller determines the length of the compaction path the ram body travels during each compaction cycle based on the input received from the fullness reporting module, wherein at the end of each compaction cycle in which the material height is below a maximum height, the controller receives a post-compaction height from the fullness-reporting module and brings the ram body to rest at a height below the home position and above the post-compaction height.

2. The collection apparatus of claim 1 wherein the controller further receives input from a compaction motor load sensor indicating the load placed on the motor during each compaction cycle, further wherein the controller limits the travel of the ram body along the compaction path in a compaction cycle to a distance short of the maximum travel position based upon the combination of the material height and compaction motor load from a previous compaction cycle.

3. The collection apparatus of claim 1 wherein the controller further receives input from a weight sensor indicating the weight of the material in the collection bin, wherein the controller suspends compaction cycle activity when the weight sensor indicates the collection bin is storing a maximum weight of material.

4. The collection apparatus of claim 1 wherein the compacting mechanism is battery powered and the controller receives input from a battery charge level sensor, wherein the controller powers off all of the electronic functions of the collection apparatus when the battery charge level is inadequate to run a subsequent compaction cycle.

5. The collection apparatus of claim 1 further including a wireless communication module that communicates information from the fullness-reporting module to a remote server.

6. The collection apparatus of claim 5 wherein the wireless communication module communicates information to one or more other collection apparatuses.

7. The collection apparatus of claim 5 further including a weight sensor indicating the weight of the material in the collection bin, wherein the wireless communication module communicates information from the weight sensor to the remote server.

8. The collection apparatus of claim 5 further including a location services module in communication with the wireless communication module that reports the location of the collection apparatus to the remote server.

9. The collection apparatus of claim 5 wherein the remote server receives information from the fullness-reporting module of each of a plurality of collection apparatus, wherein the remote server calculates a collection schedule for the plurality of the collection apparatus.

10. The collection apparatus of claim 1 further including a visual indicator visible from the exterior of the collection apparatus, wherein the visual indicator indicates a fullness level of the collection bin based on information provided by the fullness-reporting module.

11. The collection apparatus of claim 1 wherein electrical components of the collection apparatus are solar powered.

* * * * *